United States Patent [19]

Okinaka et al.

[11] 3,992,152

[45] Nov. 16, 1976

[54] GOLD PLATING TEST PROCEDURE

[75] Inventors: Yutaka Okinaka, Madison; Miles Vincent Sullivan, Summit, both of N.J.

[73] Assignee: Bell Telephone Laboratories, Incorporated, Murray Hill, N.J.

[22] Filed: May 3, 1976

[21] Appl. No.: 682,323

[52] U.S. Cl. ..... 23/230 C
[51] Int. Cl.[2] ..... G01N 33/20
[58] Field of Search ..... 23/230 C

[56] References Cited

UNITED STATES PATENTS 3,700,469 10/1972 Okinaka ..... 427/430

3,937,638 2/1976 Plewes ..... 148/12.7

*Primary Examiner*—Robert M. Reese
*Attorney, Agent, or Firm*—Walter G. Nilsen

[57] ABSTRACT

A process is described for making devices with gold plated surfaces in which a procedure is carried out to determine if visual defects in the gold plated surface have exposed base metal. This procedure is advantageous because defects with exposed base metal are detrimental to device reliability and longevity.

11 Claims, 2 Drawing Figures

GOLD PLATING TEST PROCEDURE

BACKGROUND OF THE INVENTION

1. Field of the Invention

The invention involves a procedure for producing gold plated surfaces.

2. Description of the Prior Art

Gold plating is extensively used in the manufacture of commercially important devices. Particularly prominent, especially in recent years, is the use of gold plating in the manufacture of electronic devices. Because of its electrical conductivity properties and absence of insulating surface layers, gold is especially useful as a conductor in electrical circuits as well as a surface metal in electrical contacting areas. For this reason gold is often plated over copper or nickel or other metals and alloys in connectors and other structures used for electrical contact.

Defects in the gold plated surface often have an adverse effect on device reliability. Although much effort has been devoted to eliminating visual defects on gold plated surfaces, such defects often persist especially in commercial production. However, it is known that not all visual defects involve exposure of base metal. Reliability is only affected adversely where the visual defect involves exposure of base metal. Thus many devices with gold plated surfaces containing visual defects need not be discarded since such visual defects do not involve exposed base metal. For this reason a convenient, rapid, nondestructive test for exposed metal in visual defects is highly desirable. In this way many devices with gold plated surfaces need not be discarded which would involve extensive economic savings.

SUMMARY OF THE INVENTION

The invention is a process for fabricating devices with gold plated surfaces in which the gold plated surface is tested for imperfections with exposed base metal by a particular procedure. In its most general form, the procedure involves having a metal or alloy more catalytic to peroxide decomposition than gold in the imperfection and exposure of the gold plated surface to aqueous peroxide. Decomposition of the peroxide solution is usually evidenced by bubbling which shows exposed base metal. Usually the base metal used catalyzes the decomposition. A preferred process involves first exposing the gold plated surface to a solution containing a metal which plates onto exposed base metal but not onto gold surfaces and which also catalyzes the decomposition of aqueous hydrogen peroxide and then exposing the gold plated surface to an aqueous peroxide solution. The base metal preferably contains either copper, tin or nickel either in substantially pure form or as an alloy such as beryllium copper, brass, phosphor bronz or nickel-tin. The alloys of nickel, tin and copper described in U.S. Pat. No. 3,937,638 are also useful. The plating of catalytic metal on base metal may be of several kinds (electroless, displacement etc.), but displacement plating is generally contemplated. A number of metals may be used as the metal displacement ion but platinum is particularly advantageous because of its high catalytic activity towards the decomposition of aqueous hydrogen peroxide. The concentration of the peroxide may vary over large limits including from 1/100 to 30 weight percent, but 1–3 weight percent is preferred because of ease of decomposition and ease of safe handling of this concentration range. This procedure is an inexpensive, rapid method of detecting exposed base metal which is nondestructive so that devices without exposed base metal need not be discarded.

DETAILED DESCRIPTION

Figure 1:
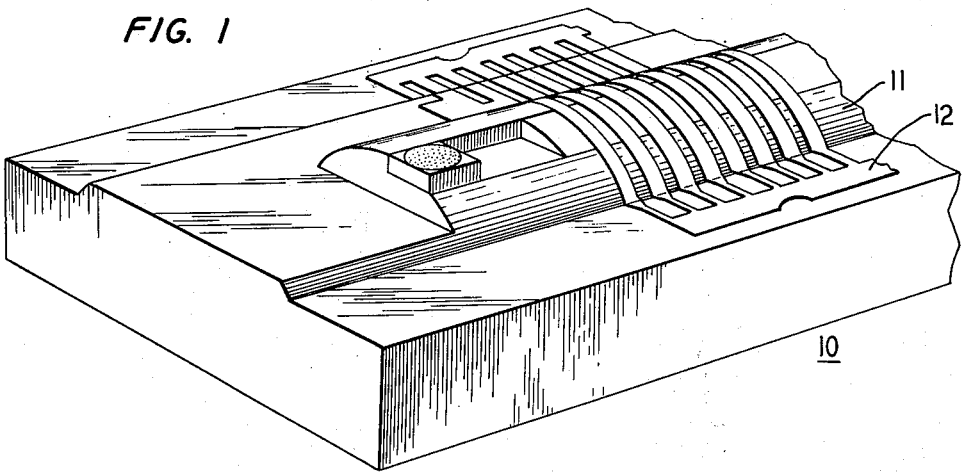
FIG. 1 shows, in section, part of an electrical connector with gold plated surface suitable for testing using the inventive procedure.

A variety of articles and devices have gold plated surfaces. Generally jewelry and other decorative articles are often gold plated to prevent surface corrosion and to beautify the surface. In such articles control of defects with exposed base metal is of importance because of eventual surface corrosion.

The gold plated surface may be obtained by a variety of procedures. Some procedures produce gold plating by displacement plating, others by electroless gold plating and others by the electroplating of gold. Typical procedures may be found in *Gold Plating Technology* by Frank H. Reid and William Goldie, Electrochemical Publications Ltd., 1974, and *Modern Electroplating* by F. A. Lowenheim, John Wiley & Sons, New York, 3rd Edition, 1974, especially Chapters 8 and 13. Electroless plating procedures are illustrated by U.S. Pat. No. 3,700,469 issued on Oct. 24, 1972 to Y. Okinaka.

Although this process may be used on a large variety of gold plated surfaces, it is particularly applicable to gold plated surfaces used in electronic devices. It is most applicable to electrical contact surfaces since small amounts of corrosion in such situations have large adverse effects on electrical contact resistance. Thus the gold plated surface used in this procedure may often have hard gold containing a hardening metal such as cobalt.

In its most general form, the procedure for detecting gold plating defects with exposed base material involves first insuring that the exposed base material has a substance which catalyzes peroxide decomposition and then exposing the gold plated surface to an aqueous peroxide solution. The substance which catalyzes the peroxide decomposition may be put onto the base material in a variety of ways including actual sensitizing and acceleration of the base surface.

The preferred procedure used to detect defects with exposed base metal involves first the exposure of the gold plated surface to a solution of a metal which displacement plates on the base metal and also catalyzes the decomposition of hydrogen peroxide. Typical metals are silver, platinum, iridium, osmium, palladium and rhodium. The metals are preferably in the form of an acidic solution generally of chloride with pH less than 6. The metal ions should be contained in an acidic solution, preferable with pH less than 6. Any anion compatible with the metal ions and acid may be used including chlorides, bromides, fluorides, nitrates, sulfates, etc. Naturally, chloride or hydrochloric acid should not be used with silver because of the precipitation of silver chloride. Chloride is preferred because of ease of availability and compatibility with hydrochloric acid. A variety of acids may be used including hydrochloric acid, sulphuric acid, nitric acid and acetic acid. Hydrochloric acid is preferred because of compatibility with most metal ions, absence of possibly complicated oxidative actions and the fact that it completely evaporates when water is evaporated. Platinum is the preferred ion because of its strong catalytic effect on the decomposition of aqueous hydrogen peroxide. A 0.01–1.0 weight percent solution of platinum tetrachloride in hydrochloric acid gives excellent results as well as a 0.01–1.0 weight percent solution of chloroplatinic acid. Generally the surface is thoroughly rinsed with water before proceeding to the next step.

The surface being tested is next exposed to an aqueous peroxide solution. A concentration of from 1/100 weight percent to 30 weight percent may be used. However, a concentration range of from 1 to 3 weight percent is preferred. Above 3 weight percent the solution becomes difficult to handle safely and below 1 weight percent the reaction is inconveniently slow.

The presence of exposed base metal is shown by the bubbling decomposition of the aqueous peroxide solution. Visual aids such as microscopes, eyepieces, etc. may be used to help observe the decomposing peroxide. Absence of such an effect in the vicinity of a visual defect indicates that the visual defect does not have exposed base metal and therefore will not adversely affect the performance and longevity of the device. Because of this test many devices with visual defects are shown to be satisfactory for operation in an electronics system.

FIG. 1 shows a portion of a connector 10 with associated structure 11 usually made of nonconductive material and beryllium copper metal 12 which has been plated with gold. This gold plating is tested for exposed base metal by the procedure described above.

The invention may be illustrated by a particular example. A surface which is part of an electronic device is gold electroplated by exposing the surface to a solution of 24 gm/l of potassium gold cyanide, 100 gm/l of citrate acid anhydrous, 5 gm/l of KOH and 150 ppm of cobalt citrate. The surface is gold electroplated for a period of 10 minutes using a current density of 150 milliamperes per centimeter square of plated surface. The surface is then thoroughly rinsed with water and exposed to a solution of platinum tetrachloride in hydrochloric acid for 10 seconds, then rinsed with water and exposed to a 3 weight percent solution of peroxide. The absence of any decomposition of the peroxide indicates the absence of exposed base metal. Often, the gold plated surface is tested for visual defects before use of the inventive procedure and only surfaces with visual defects are further tested for exposed base metal.

Figure 2:
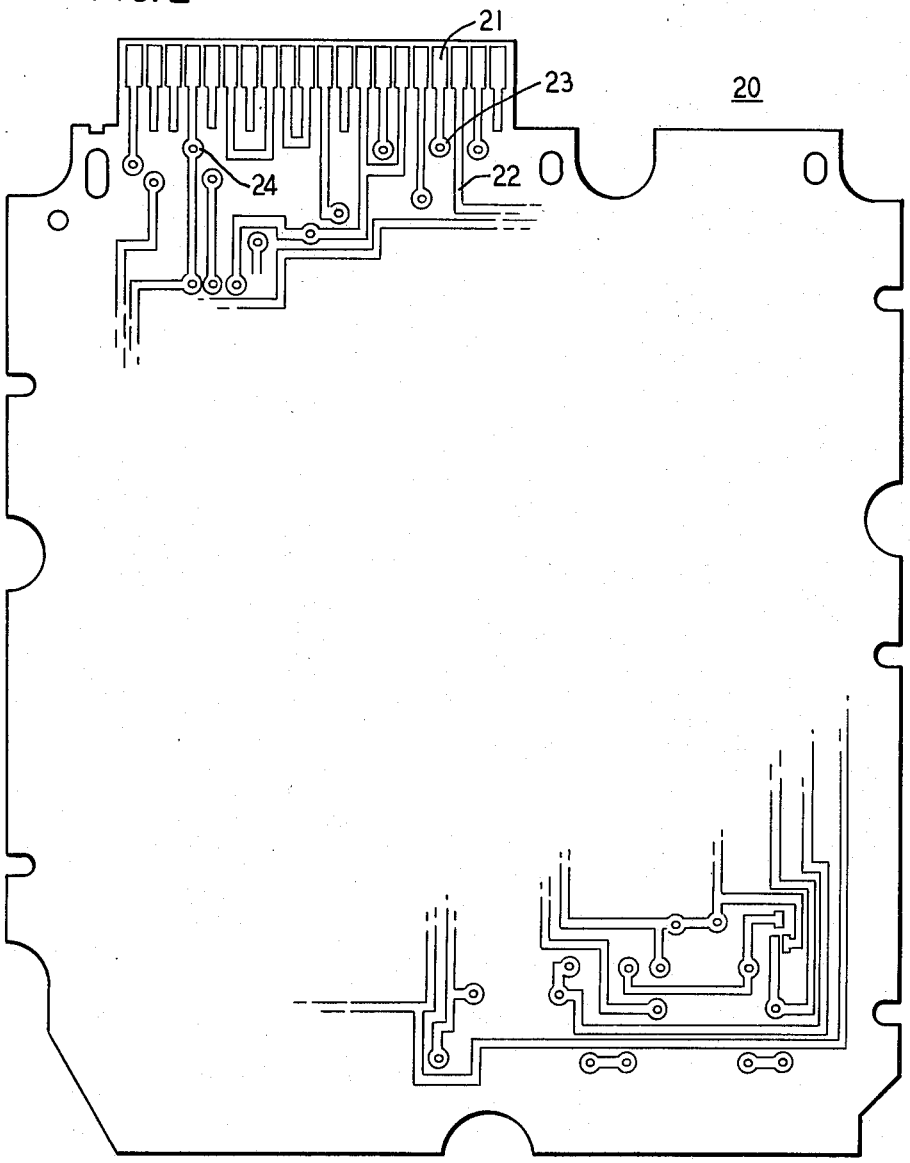
FIG. 2 shows a typical electrical circuit employing gold-plated fingers made and tested according to the inventive process.

The process may also be used for producing circuits with gold plated fingers or other gold plated surfaces. A typical circuit 20 is shown in FIG. 2 with gold-plated fingers 21, conductive paths 22 and provisions 23 for mounting components and electrically connecting conductive paths on the front of the circuits to conducting paths on the back of the circuit 24.

A variety of procedures are used to gold plate the fingers. Although displacement or electroless plating may be used, generally electroplating is used. The fingers (usually made of copper or nickel) are first given a thin (~10 microinches) strike of soft gold. The fingers are then electroplated at a current density of about 5–10 ma/cm$^2$ for approximately 10–20 minutes with hard gold. The electroplating solution generally contains $KAu(CN)_4$, phosphates or citrates to add conductivity and 50–200 ppm cobalt to harden the gold.

The gold plated surfaces are tested for exposed base metal by first exposing the surface to a solution of platinum tetrachloride in dilute hydrochloric acid and then, after washing the surface with water, exposing the surface to a 3 weight percent aqueous solution of peroxide. If no exposed base metal is present, the circuit is completed by attachment of necessary components and soldering necessary connections, etc.

What is claimed is:

1. A process for producing articles and devices with gold plated on base material surface comprising the steps of:

a. plating the base material surface with gold to form a gold plated surface and b. testing the gold plated surface for exposed base material characterized in that the testing procedure comprises the steps of first insuring that defects with exposed base material contain substance with greater catalyzing activity toward peroxide decomposition than gold and then exposing said gold plated surface to an aqueous peroxide solution.

2. The process of claim 1 in which the aqueous peroxide solution has a concentration between 1/100 and 30 weight percent.

3. The process of claim 2 in which the aqueous peroxide solution has a concentration between 1 and 3 weight percent.

4. The process of claim 1 in which the acid solution has a pH less than 6.

5. The process of claim 4 in which the acid solution contains an acid selected from the group consisting of hydrochloric acid, sulfuric acid, nitric acid, and acetic acid.

6. The process of claim 5 in which the metal ion is in the form of chloroplatinic acid.

7. The process of claim 1 in which the base material comprises at least one metal selected from the group consisting of copper, nickel and tin.

8. The process of claim 7 in which the gold plated surface is first exposed to an acid solution of a metal ion selected from the group consisting of silver, platinum, iridium, osmium, palladium and rhodium and then exposed to an aqueous peroxide solution.

9. The process of claim 8 in which the metal ion is platinum.

10. The process of claim 9 in which the acid solution of a metal ion consists essentially of an aqueous solution of platinum tetrachloride in hydrochloric acid.

11. The process of claim 10 in which the concentration of platinum tetrachloride is from 0.01 to 1.0 weight percent.

* * * * *